United States Patent [19]

Brückner et al.

[11] 4,290,147

[45] Sep. 22, 1981

[54] HANDPROTECTOR FOR ATHLETES

[75] Inventors: Georg F. Brückner; Bernd Geike, both of Berlin; Fritz Berger, Ottobeuren; Bernd-Jürgen Schoen, Grafenau, all of Fed. Rep. of Germany

[73] Assignee: Metzeler Schaum GmbH, Menningen, Fed. Rep. of Germany

[21] Appl. No.: 90,982

[22] Filed: Nov. 5, 1979

[30] Foreign Application Priority Data

Nov. 3, 1978 [DE] Fed. Rep. of Germany ..... 2847867

[51] Int. Cl.[3] ..... A41D 13/08

[52] U.S. Cl. ..... 2/18; 2/161 A

[58] Field of Search ..... 2/16, 17, 18, 19, 20, 2/21, 158, 159, 161 A, 167

[56] References Cited

U.S. PATENT DOCUMENTS

| | | | |
|---|---|---|---|
| 2,574,086 | 11/1951 | Broderick | 2/18 |
| 3,855,633 | 12/1974 | Rhee | 2/18 |
| 3,903,546 | 9/1975 | Rhee | 2/18 |
| 3,945,045 | 3/1976 | Rhee | 2/18 |

FOREIGN PATENT DOCUMENTS

| | | | |
|---|---|---|---|
| 7808068 | 8/1978 | Fed. Rep. of Germany . | |
| 1061874 | 4/1954 | France | 2/18 |

*Primary Examiner*—Louis Rimrodt

*Attorney, Agent, or Firm*—Herbert L. Lerner; Laurence A. Greenberg

[57] ABSTRACT

Handprotector for athletes, including a one-piece protective cushion of soft polyurethane integral foam having a tubular forearm region surround the forearm and the wrist, the tubular forearm region having a narrow slit formed therein over the entire length thereof along the inside of the arm, a balloon-shaped hand region adjacent the forearm region, the hand region being bent back approximately 180° from the back of the hand in the vicinity of the fingertips to form the shape of a closed fist, a molded finger grip strap disposed on the inside of the hand region, and a protective thumb cover disposed adjacent the hand region and extending over the thumb at the side of the forearm region, the thumb cover being closed at the outer side of the handprotector.

7 Claims, 2 Drawing Figures

HANDPROTECTOR FOR ATHLETES

Figure 1:
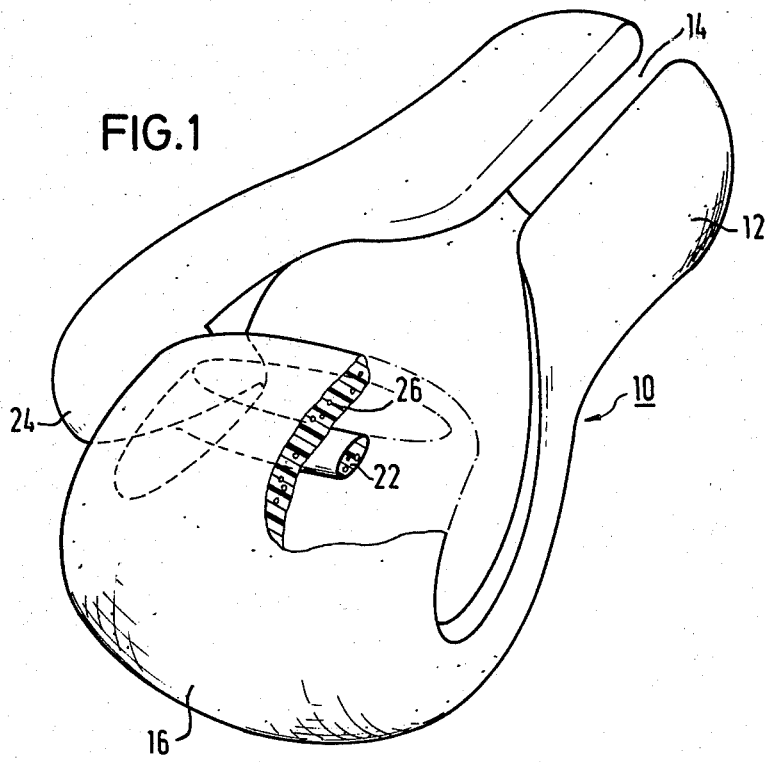

The invention relates to a glove-shaped hand protector made of a foam material which serves as a cushion for absorbing impacts.

In the martial arts, particularly in boxing and the type of karate known as "Contact Karate", the hands of the participating athletes must be protected by some cushioning, such as boxing gloves, for example, However, boxing gloves are not suitable for contact karate, because the seams can easily cause injuries. Furthermore, boxing gloves are relatively expensive.

Moreover, so called "Punch-cushions" have been developed for the boxing sport. On the back of these punch-cushions, a kind of glove is attached, so that the hand of the cushion points forward. With this device, different punching or hitting techniques can be practiced. These punching-cushions are made of leather with a filling of horse-hair, coco-fiber or a similar material.

However, these punching cushions cannot be used for special hand-and leg combinations, as are required in the sport of karate.

There also exist forearm protectors which are made of leather and synthetic leather, respectively, with a filling of foam material, textile-wastes or similar materials. These fill materials are usually quickly destroyed by the punches and impacts which occur in karate. Furthermore, these underarm cushions are one-sided i.e. they can only be used on one side thereof, as is true of the abovedescribed "boxing paws".

Finally, there are also punching cushions which include two Latex discs having a thickness of approximately 4 cm. These Latex discs are bonded to a rubberized fabric at two places, so that they hold together and form a unit. The disadvantage thereof is that the fingers must hold this handprotector in a particular way, and with this manner of holding, they can be easily injured. This handprotector is also not very durable, and tears during training after the first application of stress. Tears formed in this manner can cause injuries. German Petty Patent DE-GM No. 78 08 068 discloses a handprotector which is specially made to be used for karate. However, the hand region of this previously known handprotector is quite weak, and only curved in the finger region. Clenching of the fist, which is required for the sports in question, must be effected by muscle force, i.e. the athlete bends the handprotector to the required shape. The securing of the protector in the forearm region is done by winding the flat material around the forearm, and fastening it with straps. It is obviously not possible to do this without the help of another person. A further disadvantage is that the tube-shaped thumb protector is open toward the front. This may cause injuries by scratching an opponent, and the wearer of the protector may also injure his own thumb considerably. With respect to the material used, the publication points out that the material described therein also includes a soft polyurethane foam.

It is accordingly an object of the invention to provide a handprotector for athletes which overcomes the hereinaforementioned disadvantages of the heretofore known devices of this general type, and which is capable of withstanding all stresses involved over an extended time period, and simultaneously provides optimal protection to the hand and forearm of the athlete. Furthermore, it is an object of the invention to provide a handprotector which permits an uncramped hand position and is capable of being put on and taken off easily, while excluding the danger of injury to the wearer.

With the foregoing and other objects in view there is provided, in accordance with the invention, a handprotector for athletes especially for use in karate, comprising a one-piece protective cushion of soft polyurethane integral foam having a tubular forearm region surround the forearm and the wrist, the tubular forearm region having a narrow slit formed therein over the entire length thereof along the inside of the arm, a balloon-shaped hand region adjacent the forearm region, the hand region being bent back approximately 180° from the back of the hand in the vicinity of the fingertips to form the shape of a closed fist, a molded finger or hand grip strap disposed on the inside of the hand region, and a separate protective tube-shaped thumb cover disposed adjacent the hand region and extending over the thumb at the side of the forearm region, the thumb cover being closed at the outer side of the handprotector. The advantages achieved by the invention are particularly based on the use of a one-piece formed part made of soft polyurethane integral foam. The material used herein has an almost airtighly closed skin-like surface, which is formed during the foaming process, and which forms surface zones of greater density. The usual cellular core of the foam material is inside this skin-like surface. The unitform molecular polymerization of the foam material causes an exceptional elasticity, while air within the cell which is enclosed in the skin-like surface acts as a kind of "air cushion".

The massive, closed skin-like surface, which continues into the cellular core like a sandwich is generated when this material foams in the form, without the necessity of going through an additional operation or using additional material.

The formed parts are laquered after being removed from the mold to obtain additional sealing of the surface and to improve the durability of the formed part.

During a deformation caused by a punch and impact of the handprotector, part of the kinetic energy is absorbed by the deformation of this integral foam. Furtheremore, the air contained in the core of the formed part is compressed, which also aids in the greater part of the kinetic energy being absorbed. In this manner, the greatest part of the punch and impact energy is captured, so that the athlete's hand is optimally protected.

After the end of the punch or hit, i.e. after the load is removed from the handprotector, the integral foam quickly returns to its original form. This recovery is helped by the expansion of the enclosed air, so that such a handprotector can fully perform its function even after extended usage.

Through a suitable construction of the form being used, the formed part can be shaped in such a way that it can be used for practicing both hand-technique, leg technique or a combination of these techniques in contact karate. The handprotector should extend over the hand, and over the forearm as well, in order to protect these areas in particular, by protecting endangered regions.

The handprotector is constructed in such a way that it can be used from all sides during training without endangering the training partner. It offers a large practice-surface for hand, leg, punch and push techniques, which can be performed with great force without any danger of injury.

Finally, it has been found by testing that a handprotector of this type, due to the material used, remains fully functional, even with the heaviest usage, as is the case during continuous training.

In accordance with another feature of the invention, the forearm region covers at least part of the palm of the hand so that it reaches beyond the ball of the hand.

In accordance with a further feature of the invention, the forearm region has a tickness of approximately 15 mm and the hand region has a thickness of approximately 5 cm in vicinity of the knuckles.

In accordance with an additional feature of the invention, there is provided a slot formed near the end of the hand region forming the finger grip.

In accordance with an added feature of the invention, there is provided a bur-type fastener extending from one part of the forearm region to another part thereof across the narrow slit.

In accordance with a concomitant feature of the invention, the thumb cover protrudes from a point of the hand region to form a closed forward or head portion for the other four fingers.

Other features which are considered as characteristic for the invention are set forth in the appended claims.

Although the invention is ilustrated and described herein as embodied in handprotector for athletes, it is nevertheless not intended to be limited to the details shown, since various modifications and structural changes may be made therein without departing from the spirit of the invention and within the scope and range of equivalents of the claims.

Figure 2:
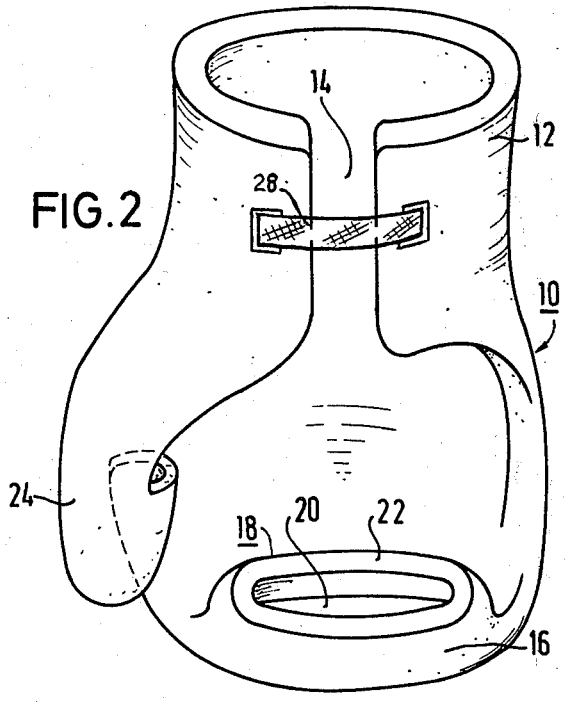

The construction and method of operation of the invention, however, together with additional objects and advantages thereof will be best understood from the following description of specific embodiments when read in connection with the accompanying drawing, in which:

FIG. 1 is a diagrammatic perspective view, partly broken away, of a handprotector according to the invention, the broken away part showing the cellular structure of the foam material; and FIG. 2 is a diagrammatic perspective view of the inner surface of the handprotector taken from the front and slightly from the top.

Referring now as a whole to FIGS. 1 and 2 of the drawing, it is seen that the whole handprotector is designated with reference numeral 10 and is formed of soft polyurethane-integral foam, which forms a surface of greater density toward the outside, and has a cellular core 26, as can be seen in FIG. 1.

The handprotector 10 has a tube-shaped forearm portion 12 with a thickness of approximately 15 mm. This forearm portion 12 is provided with a longitudinal slot 14, so that the forearm region 12 is widened, and the forearm can be inserted using the wider slot 14.

The slot 14 is disposed at the inside of the handprotector 10 i.e. in the region of the inner forearm, extending to the palm of the hand.

On the side opposite the slot 14, the forearm region 12 continues into the hand region 16, which arches upward and forward like a balloon, and has a thickness of approximately 5 mm in the portions where the highest stresses occur, particularly in the zone of the natural punching point over the knuckles.

The hand region 16, which is again back in the direction of the forearm region 12 at the end thereof, ends in a finger-holder 18, which is formed by a slip 20 between the forward end zone of the hand region 16 and a single strap 22.

Separated from this hand region 16, there is provided a tube-shaped thumb protector 24, which is disposed alongside the balloon-shaped arched hand region 16.

In the region of the slot 14, the forearm region 12 extends far enough forward so that the palm is also partly covered. Protection is thereby provided even if prohibited inner-hand punches should occur.

To put on the handprotector 10, as mentioned hereinbefore, the slot 14 is somewhat opened, so that the forearm can be inserted through the slot 14 into the forearm region 12. The tips of the fingers are then placed into the opening 20 of the finger holder 18, so that the hand has the position of a closed fist. An ideal position of the fist for hitting is thereby maintained. This allows the maintenance of a 90° optimal position between the back of the hand and the upper finger bones.

While four fingers are in the fingerholder 18, the thumb is separately inserted into the thumb-protector 24, and is completely enclosed therein, so that it is also optimally protected.

The handprotector 10 is open at the side of the thumb, so that it can be easily taken off.

Though the handprotector 10 is already relatively well fastened to the forearm and the hand, respectively, by the hereinaforedescribed measures, an additional feastening device is provided by means of a bur-type fastener 28, disposed above the wrist The bur-type fastener may be a separable hook and loop-type fastener, possible made of nylon. Such a fastener is available from Velcro Inc. of New Hampshire, under the trade name VELCRO. This provides additional protection for the wirst joint. Furthermore, a cuff-like reinforcemnt results therefrom so that the handprotector cannot slip out of position, and cannot twist when stressed in in punching.

The fist of the ahtlete is in its natural position during all hitting motions, so that cramps will not occur. Furthermore, all fingers, including the thumb are completely covered so that no injuries can be inflicted either to an opponent or to a partner. Additionally, the padding of the handprotector can be increased at the anatomically essential places, whereby improved protection is provided thereat. Finally, due to the functional shape of the handprotector 10, the device will not wear out quickly.

In the manufacture of the handprotector 10 of the invention, a life-size plaster model is first prepared. From the model a mold is made. By filling the mold with the starting material for soft polyurethane integral foam, the handprotector 10 can be made in the conventional manner.

After removal from the mold, the formed body of soft polyurethane integral foam is provided with a thin laquer coating, which also contributes to its durability. Thereafter the handprotector is ready for use.

There are claimed:

1. Handprotector for athletes, comprising a seamless one-piece protective cushion of soft and elastic polyurethane integral foam having a tubular forearm region surrounding the forearm and the wrist, said tubular forearm region having a narrow slit formed therein over the entire length thereof along the inside of the arm, a balloon-shaped hand region adjacent said forearm region, said hand region being bent back approximately 180° from the back of the hand in the vicinity of the fingertips to form the shape of a closed fist, a finger grip strap being integrably molded to said hand region and disposed exclusively on the inside thereof, and a protective thumb cover disposed adjacent said hand region and extending over the thumb at the side of said forearm region, said thumb cover being closed at the outer side and at least part of the inner side of the handprotector.

2. Handprotector according to claim 1, wherein said forearm region covers at least part of the palm of the hand.

3. Handprotector according to claim 1, wherein said forearm region has a thickness of approximately 15 mm.

4. Handprotector according to claim 1, wherein said hand region has a thickness of approximately 5 cm in vicinity of the knuckles.

5. Handprotector according to claim 1, including a slot formed near the end of said hand region forming said finger grip.

6. Handprotector according to claim 1, including a bur-type fastener extending from one part of said forearm region to another part thereof across said narrow slit.

7. Handprotector according to claim 1, wherein said thumb cover protrudes from a point of said hand region.

* * * * *